United States Patent [19]

Motten, Jr.

[11] 4,257,662

[45] Mar. 24, 1981

[54] FUSEHOLDER WITH SEPARATE REJECT SPRING HAVING INTEGRAL SPREADING AND COLLAPSING CONTROL MEANS

[75] Inventor: Roger H. Motten, Jr., Deltona, Fla.

[73] Assignee: Marathon Electric Manufacturing Corp., Wausau, Wis.

[21] Appl. No.: 89,760

[22] Filed: Oct. 30, 1979

[51] Int. Cl.[3] ..... H01R 11/22; H01R 13/64

[52] U.S. Cl. ..... 339/186 R; 339/258 F

[58] Field of Search ..... 337/231, 234, 252, 260; 339/252 F, 253 F, 256 C, 256 R, 258 F, 219 F, 259 F, 262 F, 270 F, 184 R, 186 R

[56] References Cited

U.S. PATENT DOCUMENTS

| | | | |
|---|---|---|---|
| 1,451,296 | 4/1923 | Gibbons | 339/259 F |
| 1,955,251 | 4/1934 | Ohlson | 339/270 F |
| 2,659,063 | 11/1953 | Webb et al. | 339/253 F |
| 2,889,533 | 6/1959 | Nielsen | 339/256 C |
| 2,943,295 | 6/1960 | Stewart | 339/258 F |
| 3,914,005 | 10/1975 | Tillson | 339/258 F X |
| 3,984,801 | 10/1976 | Mrenna et al. | 337/252 |
| 4,097,114 | 6/1978 | Motten | 339/259 F |
| 4,108,531 | 8/1978 | Reynolds | 339/258 F |

*Primary Examiner*—Eugene F. Desmond

*Attorney, Agent, or Firm*—Andrus, Sceales, Starke & Sawall

[57] ABSTRACT

A fuseholder with a reject spring which will only accept a ferrule type fuse with an annular groove in the ferrule at one end. The reject member is a reinforcing spring located externally of the fuse clip on the fuseholder and has locking or control members integrally connected to abutments extending through complimentary openings in the sides of the fuse clip. The arms of the spring are connected together in a manner to control lateral movement of the fuse clip within a predetermined distance and also controls lateral movement of the abutments to respectively accept only the groove of a ferrule type fuse when moved outwardly. The reinforcing spring with the reject abutments finds use on fuseholders having no or very low barriers.

7 Claims, 13 Drawing Figures

FUSEHOLDER WITH SEPARATE REJECT SPRING HAVING INTEGRAL SPREADING AND COLLAPSING CONTROL MEANS

BACKGROUND OF THE INVENTION

Fuse clip construction with a reject spring have been used on fuseholders having a high barrier which can be engaged by projection means extending outwardly from the spring to limit outward movement of the reject spring. This is exemplified by the reject spring construction disclosed and claimed in patent application Ser. No. 791,795 filed Apr. 28, 1977 and which is assigned to the assignee of the present invention. The present invention is directed to a reject and reinforcing spring construction for use on a fuseholder with no or very low barriers and the spring has complementary abutments which reject the insertion of a fuse in the clip which does not have a groove and therefore will only accept ferrule type fuses having an annular groove at one end. The reject spring also has inwardly extending control members at the rear which are connected together in a manner to provide for a limited predetermined outward or inward movement of the abutments of the spring.

SUMMARY OF THE INVENTION

The present invention is directed to a reject member which is a reinforcing spring separate from the fuse clip and located externally of the clip and together with the clip secured to the base of the fuseholder. Inwardly extending abutments or ears on the reinforcing spring extend through complementary openings in opposite sides of the clip to engage the annular groove in ferrule type fuses. Integral members of the reject and reinforcing spring extend around the rear or end of the fuse clip and have inwardly projecting control arms which are latched together in a manner permitting a predetermined outward and inward movement of the abutments or ears of the spring so that the clip can be employed on a fuseholder which has low or no barriers located outwardly of the fuse clip to limit movement of the clip.

DESCRIPTION OF THE PREFERRED EMBODIMENT

Figure 5:
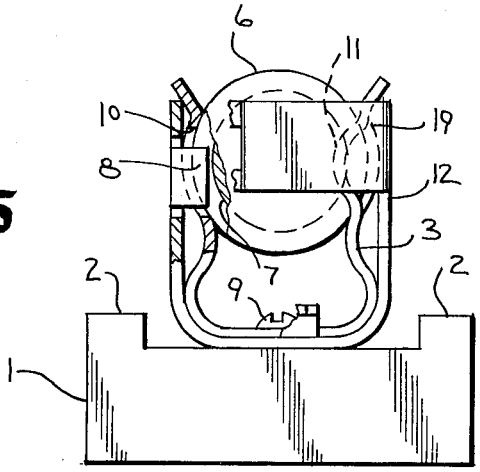
FIG. 5 is an end view of FIGS. 3 and 4 with these members secured to a low barrier fuse block with parts broken away and a fuse in place.
Figure 6:
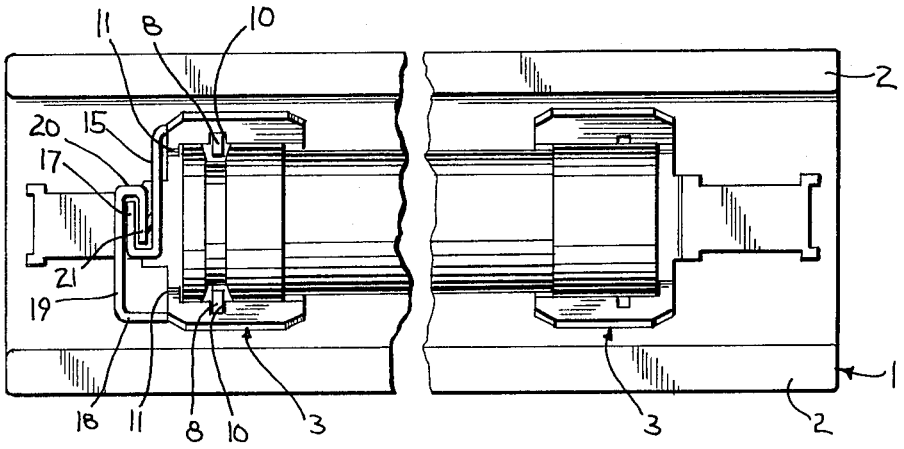
FIG. 6 is a top plan view of a fuseholder illustrating the first latching embodiment of the invention and with a ferrule type fuse as shown in FIG. 2.
Figure 10:
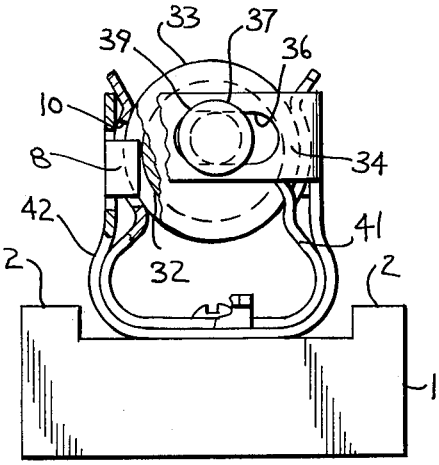
FIG. 10 is an end view illustrating the use of the reinforcing spring of FIG. 7 with a contoured type of fuse clip.

As illustrated in FIG. 6, a fuseholder is shown which has a flat body or base 1 with generally low side walls 2, as seen in FIGS. 5 and 10 of the drawings, and has the fuse clips 3 secured thereto at each end.

Figure 1:
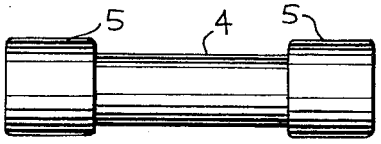
FIG. 1 is a side elevational view of a fuse with ungrooved ferrules at both ends.
Figure 2:
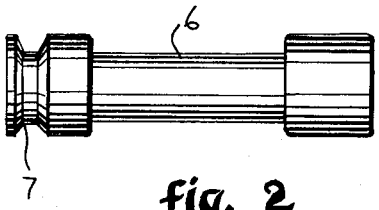
FIG. 2 is a side elevational view of a fuse with an annular groove in one of the ferrules.

FIG. 1 illustrates a fuse 4 with ungrooved ferrules 5 at each end and is the type of fuse to be rejected from the fuseholder because it is not the proper fuse for use in the fuseholder. FIG. 2 illustrates a ferrule type fuse 6 which has an annular groove 7 in one of the ferrules which will be received by one of the inwardly turned abutments 8 as shown in FIG. 6 and other figures of the drawings. Abutments 8 will reject the ungrooved fuse 5.

Figure 4:
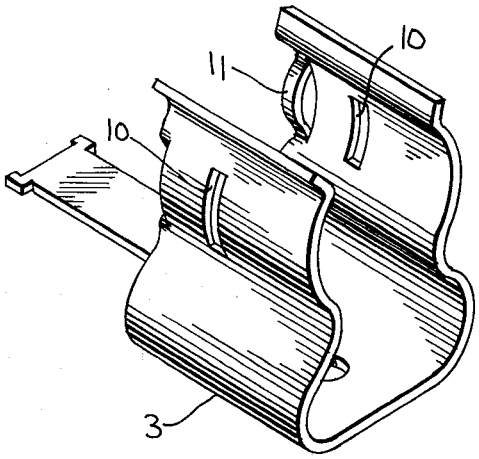
FIG. 4 is a perspective view of a fuse clip with which the reinforcing spring of the invention is employed.

Fuse clip 3 as shown in FIG. 4, is a standard fuse clip which is secured to base 1 by the screws 9 or the like. Clip 3 is flared outwardly at the upper open end to more readily insert a fuse in the clip, such as fuse 6. Both side walls of clip 3 have complementary openings or slots 10 and the inset ears 11 at the outer end to prevent lengthwise movement of fuse 6 when it is in place.

Figure 3:
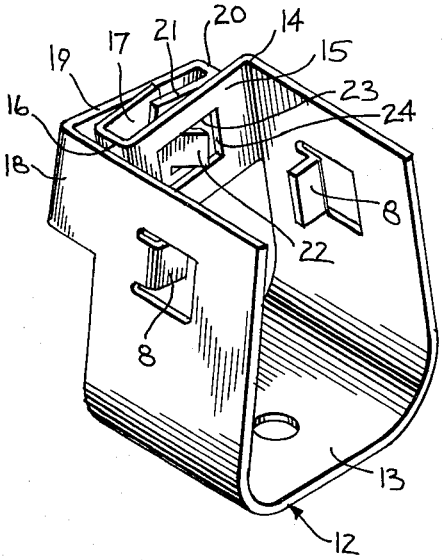
FIG. 3 is a perspective view illustrating one embodiment of the reinforcing spring of the invention.

FIG. 3 illustrates a reinforcing and reject spring 12 with interlocking or latching control means which is the first embodiment of the invention. Spring 12 has a generally flat base 13 and is located between clip 3 and base 1, as seen in FIG. 5, and is secured to base 1 by the screws 9 which secure clip 3 to the base, as illustrated in FIG. 5.

When assembled with clip 3, the inwardly turned abutments 8 project inwardly of clip 3 through slots 10 and, as previously noted, operate as the reject members to prevent insertion of an ungrooved type fuse.

On the right side of spring 12, as shown in FIG. 3, the control arm 14 projects rearwardly from the upper portion of the body of spring 12 and then turns and extends inwardly to provide arm portion 15 behind fuse clip 3 and then reverse bends as at 16 to provide a generally short arm 17 which extends parallel to arm potion 15 and is spaced therefrom.

On the left side of spring 12, as shown in FIG. 3, a second control arm 18 developed complementary to arm 14 extends rearwardly from the upper portion of the body of spring 12 and then turns and extends inwardly to provide arm portion 19 behind fuse clip 3 and short arm 17 and generally parallel to short arm 17 and then reverse bends as at 20 to provide a generally short arm 21 which extends into the space between arm portion 15 and short arm 17. This in effect hooks or locks arms 14 and 18 together so that reinforcing spring 12 can only be spread a predetermined distance to accept only the ferrule type fuse 6 with groove 7 as the reverse bend 16 of arm 14 engages the end of short arm 21 which is the terminating portion of arm 18.

In order to prevent collapse of the reject and reinforcing spring 12, the short arm portion 21 is provided with a latching member or ear 22 which extends through the opening 23 in arm portion 15 in the back of the reject and reinforcing spring 12. Collapse of spring 12 is prevented when ear 22 engages the side 24 of the opening 23.

The construction of the reject and reinforcing spring 12 readily limits expansion and collapse of fuse clip 3 within predetermined limits to accept upon expansion only ferrule type fuse 6 shown in FIG. 2. The spring 12 finds particular use with a base 1 with the low side walls 2 shown in FIG. 5 because the locking connection of the control arms is an integral part of spring 12 and is not required to abut against the wall of a higher barrier fuseholder to limit outward expansion of the fuse clip.

The control arms for limiting travel of a reject and reinforcing member or spring 12 may be connected in a number of different ways other than the locking connection of the first embodiment. Such interlocking control means with the use of an elongated slot in a least one of the control members by way of example could be rivets, speed nuts, eyelets, screws, nuts or pins or by an ear on one control arm which enters a slot in the other arm and is peened over so that the control arms may not be disengaged.

Several of these ways are illustrated in the next two embodiments.

Figure 7:
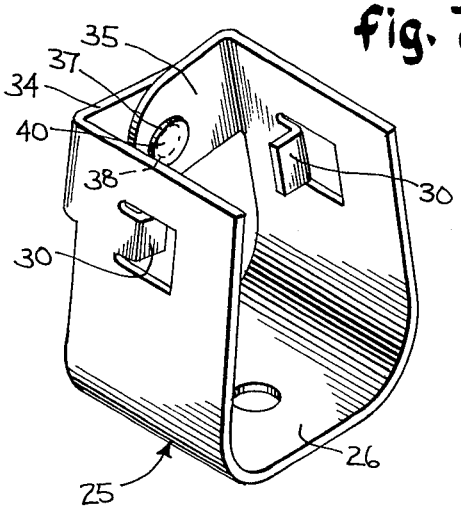
FIG. 7 is a perspective view of another embodiment of the invention.
Figure 8:
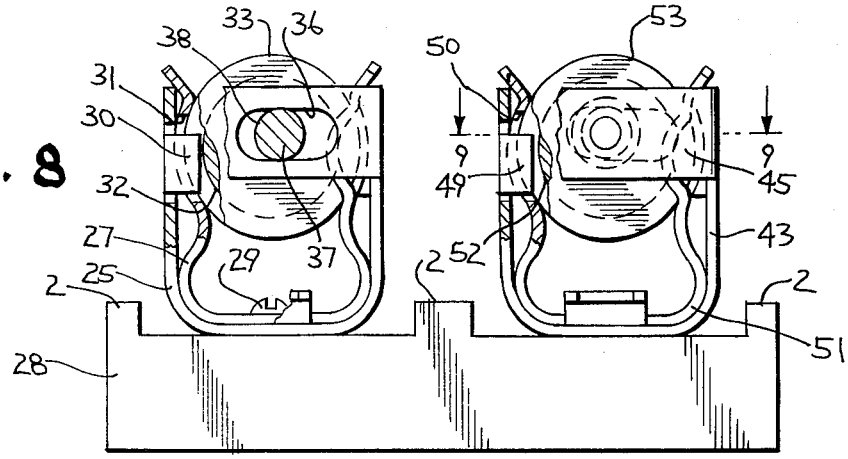
FIG. 8 is an end view of a low barrier fuse block illustrating a pair of fuse clips in place side by side on the block with the lefthand reject and reinforcing spring having the construction of FIG. 7 and illustrating in the righthand spring a third control embodimemt for securing the spring in place.

The second embodiment of an interlocking control of a reject member is illustrated in FIG. 7 and the lefthand side of FIG. 8. In this embodiment the reject spring 25 has a generally flat bottm 26 and as illustrated in FIG. 8 is located between clip 27 and is secured to base 28 by the screws 29 which also extend through clip 27 to secure the latter to base 28.

Reject spring 25 has the complementary inwardly turned abutments 30 which extend through the openings or slots 31 as illustrated in FIG. 8 in clip 27 and lodge in the groove 32 of the ferrule type fuse 33 shown in FIG. 2.

The outer control arm 34 on the left side (FIG. 7) of reject spring 25 extends slightly rearwardly of the upper portion of the body of spring 25 and then turns inwardly to overlap the inner control arm 35. Arm 35 which extends from the right side of spring 25 projects slightly rearwardly of the upper portion of spring 25 and then turns inwardly to lie inside of control arm 34.

In this embodiment an elongated slot 36 is provided in outer control arm 34, although it could be provided in inner control arm 35. A rivet 37 extends through an aperture 38 in inner arm 35 and then through slot 36 of outer control arm 34.

The head 39 of rivet 37 in the illustration (FIG. 10) is on the outside of control arm 34 and the other end of rivet 37 is peened over as at 40 to hold rivet 37 in place. However, the head 39 could also be located on the inside of control arm 35. Slot 36 would then be located in the inner control arm 35. Rivet 37 rides freely in slot 36 as the control arms 34 and 35 move outwardly to accept the groove 32 of fuse 33 and limits outward movement of the arms as the rivet engages the outer perimeter of slot 36 to provide for lodging abutments 30 in the groove 32 of a ferrule type fuse. Rivet 37 also engages the inner perimeter of slot 36 of outer control arm 34 to prevent collapse of reject spring 25. Slot 36 extends a predetermined distance to control the lateral movement of control arms 34 and 35 within the required limits.

FIG. 8 illustrates rivet 37 with head 39 removed. FIG. 10 illustrates rivet 37 with head 39 in place and the use of the rivet control construction with a contoured type of fuse clip 41 and complementary constructed reject spring 42.

Figure 9:
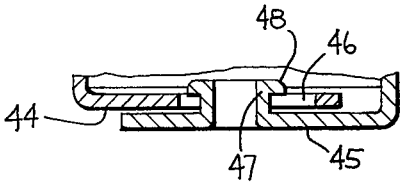
FIG. 9 is a section taken on line 9—9 of FIG. B to further illustrate the third embodiment.

A third embodiment of an interlocking control by a reject member 43 is illustrated in FIG. 8 at the right side of base 28 and in FIG. 9. In this construction the inner control arm 44 extends inside of outer control arm 45 and has the elongated slot 46 as seen in FIG. 9. The control arms are connected together by the extruded boss or eyelet assembly 47 which integrally projects from arm 45 through slot 46 in inner arm 44 and is flared out as at 48 to hold it in place. As in the second embodiment, the assembly 47 controls the lateral movement of control arms 44 and 45 inwardly and outwardly within a predetermined distance so that the abutments 49 which extend through slots 50 in clip 51 will lodge only in groove 52 of only the ferrule type fuse 53 on outward movement or prevent collapse of clip 51 on inward movement so that the clip cannot easily be removed. The assembly of FIG. 9 could also be reversed with the extruded boss of eyelet assembly 47 on the inner arm and slot 46 on the outer arm.

Figure 11:
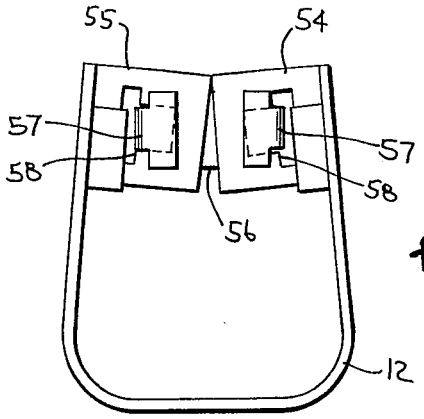
FIG. 11 is a front elevational view illustrating another embodiment of the invention.
Figure 12:
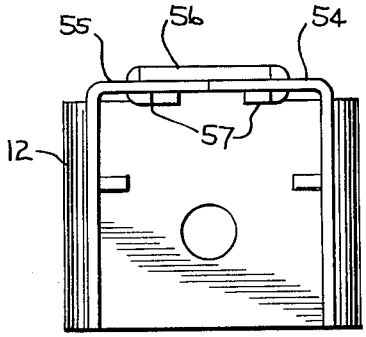
FIG. 12 is a top plan view of the latching assembly of FIG. 11.
Figure 13:
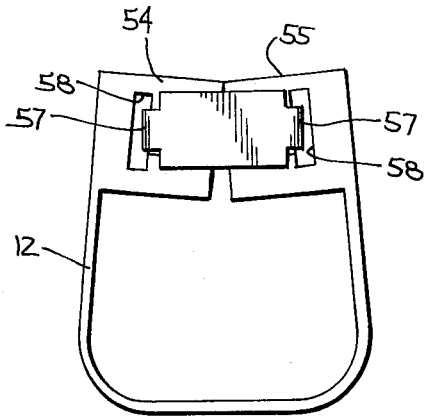
FIG. 13 is a back elevational view of the latching assembly illustrated in FIGS. 11 and 12.

FIGS. 11–13 illustrate another embodiment of the latching construction of the invention. Respective generally short control arms 54 and 55 at the rear or end of spring 12 are turned rearwardly toward each other and joined by a link 56. Link 56 has projections 57 at opposite ends of link 56 which are received within slots 58 in each link 56 and the inner ends are formed in the shape of a hook to thereby secure the link 56 to arms 54 and 55. Slots 58 are of a width to provide for some lateral movement of the control arms 54 and 55 when the projections 57 are finally secured in place.

The invention is directed to an integral fuse reject member which will reject insertion of a fuse into a fuse clip unless the fuse has a groove which will receive the abutments of the member. Lateral movement of the abutments is determined by a pair of control arms provided integrally with the reject reinforcing member which are connected together by latching or interlocking connecting means permitting inward and outward movement of the control members within predetermined limits to thereby prevent insertion of an improper fuse in the fuseholder or removal of the fuse clip by collapsing the clip inwardly.

Various modes of carrying out the invention are contemplated as being within the scope of the following claims particularly pointing out and distinctly claiming the subject matter which is regarded as the invention.

I claim:

1. A fuse rejection and reinforcing member for use with a ferrule type fuse having a groove therein disposed to be assembled with a fuse clip on a fuseholder, said fuse rejection member comprising a body portion having complementary aligned abutments extending through apertures into the inside of the fuse clip from opposite sides of the clip and adapted to receive the groove of said fuse, integral members connected to the abutments and terminating in inwardly projecting control arms at one end of the fuse clip, latching means connecting the control arms together, with said latching connection means having a construction whereby the control arms have relative lateral movement within predetermined limits to control lateral movement of the abutments within predetermined limits both outwardly and inwardly to respectively accept the groove of a ferrule type fuse when moved outwardly or prevent collapse of the fuse clip when moved inwardly.

2. The fuse rejection and reinforcing member of claim 1, and control arms each having a generally wide slot therein, and the latching connection being a link having hooked end portions lodged in a respective slot in each respective control arm to link the control arms together.

3. The fuse rejection and reinforcing member of claim 1, and the latching means being an eyelet assembly on one control arm and secured within the slot of the other control arm to hold the control arms together free for limited lateral movement.

4. The fuse rejection and reinforcing member of claim 1, said rejection member being a reinforcing reject spring, and the control arms extending rearwardly from the upper portion of the body of the spring and each arm having a reverse bend and overlapping portions hooked together to limit both the inward and outward lateral movement of the control arms and thereby control the lateral position of the abutments to respectively accept or reject a ferrule type fuse or prevent collapse of the fuse clip.

5. The fuse rejection and reinforcing member of claim 4 and one of the control arms having an opening therein and the other control arm having a latching member extending within said opening and limiting inner lateral movement of the control arms.

6. The fuse rejection and reinforcing member of claim 1, and one of the control arms having a slot therein of a predetermined length and the other of the control arms having an aperture therein, and connecting means extending through the aperture and slot and secured therein to thereby limit lateral outward and inward movement of the control arms.

7. The fuse rejection and reinforcing member of claim 6, and the connecting means being a rivet secured within the slot and aperture of the control arms to hold the control members together free for limited lateral movement.

* * * * *